US006425180B1

(12) United States Patent
Schuenemann et al.

(10) Patent No.: US 6,425,180 B1
(45) Date of Patent: Jul. 30, 2002

(54) HIGH DENSITY ELECTRICAL CONNECTOR

(76) Inventors: Donald W. Schuenemann, 21 Clearview Ave., Chalfont, PA (US) 18914; George F. Glatts, III, 2009 Carmel Dr., Jamison, PA (US) 18929; Bruce C. Cobb, 3973 Gloucester Ct., Bensalem, PA (US) 19020; Robert J. Hickey, 22 Chestnut Dr., Richboro, PA (US) 18954

( * ) Notice: Subject to any disclaimer, the term of this patent is extended or adjusted under 35 U.S.C. 154(b) by 0 days.

(21) Appl. No.: 09/776,596

(22) Filed: Feb. 5, 2001

(51) Int. Cl.[7] ..... H01R 43/16

(52) U.S. Cl. ..... 29/874; 29/876; 29/882; 140/111

(58) Field of Search ..... 29/874, 882, 879, 29/876; 140/111

(56) References Cited

U.S. PATENT DOCUMENTS 3,421,961 A 1/1969 Joyce ..... 156/296
3,579,822 A * 5/1971 Dieterich
4,186,483 A * 2/1980 Laube et al.
4,345,372 A * 8/1982 Sekigawa et al.
5,588,845 A 12/1996 Naitoh et al. ..... 439/66
5,632,626 A 5/1997 Collins et al. ..... 439/66

* cited by examiner

*Primary Examiner*—Carl J. Arbes
(74) *Attorney, Agent, or Firm*—LaMorte & Associates

(57) ABSTRACT

A high density connector element and its associated method of manufacture. The high density connector element contains a plurality of conductive wires that are arranged in parallel on the top surface of a flexible substrate. To manufacture the high density connector element, the flexible substrate is coated with an adhesive and wrapped around a cylindrical drum with the adhesive facing outwardly. Conductive wire is then wound around the cylindrical drum in a helical pattern. The conductive wire is densely wrapped around the flexible substrate on the cylindrical drum and is bound by the adhesive, thereby creating the high density connector element. After the winding is complete and the adhesive cured, at least one strip is cut from the high density connector element. The high density connector element has a flexible substrate and multiple conductive wires laid in parallel across the top surface of the substrate. Each of the conductive wires is electrically isolated from each of the other conductive wires, even when the wires are present in a highly dense pattern.

8 Claims, 3 Drawing Sheets

HIGH DENSITY ELECTRICAL CONNECTOR

BACKGROUND OF THE INVENTION

1. Field of the Invention

The present invention relates to the structure and manufacturing techniques of high density connector elements. More particularly the present invention relates to high density connector elements that are flexible and contain parallel conductors densely arranged on at least one surface.

2. Description of the Prior Art

As electronic circuitry becomes smaller and more densely populated with components, it is often difficult to interconnect separate electronic circuits using traditional soldering techniques. In many electronic assemblies, separate electronic components are placed in different areas of the assembly. Although the various electronic components will be near each other when the assembly is fully assembled, these same parts are kept apart while the assembly is dissembled. In order to electrically interconnect the various electronic components prior to the final assembly, a manufacturer often uses long connection cables to interconnect the various separated electronic components. The long connection cables are then folded up into the device as the separated electronic components are assembled. The use of such long cables is expensive, labor intensive and requires space in the final assembly to hold the folded long cables. Furthermore, the long cables often become pinched as they are folded up into the final assembly, thus causing defective assemblies.

Another solution to this problem, has been the use of elastomeric connectors. Elastomeric connectors are a class of contact connectors that contain conductive elements supported by an elastomeric body. By placing an elastomeric connector between two electronic components, the two components can be electrically interconnected as the final product is assembled and two electronic components are biased against the same elastomeric connector.

There are many different styles and designs of elastomeric connectors. The present invention addresses the family of elastomeric connectors that contain high density parallel conductors as part of their structure. In the prior art, many different manufacturing techniques have been developed to produce densely packed parallel conductors on a substrate. Such prior art techniques include the use of photo lithography, such as is exemplified by U.S. Pat. No. 3,421,961 to Joyce, entitled Method Of Making High Density Electrical Connections. Other techniques include chemical addition processes, where the conductors are plated onto a substrate, and plasma removal processes, where lines are removed from a conductive film on a substrate.

Although such prior art techniques work, they require very expensive manufacturing tools. Furthermore, due to the high dimensional tolerances needed, such prior art manufacturing techniques have a high rate of defective products that are scrapped.

Once high density conductors are produced on a substrate, that substrate can be cut into strips to produce high density flexible cables. Alternatively, the substrate can be wrapped around an elastomeric body to produce an elastomeric connector. Such elastomeric connectors are exemplified by U.S. Pat. No. 5,632,626 to Collins, entitled Retention Of Elastomeric Connector In A Housing and U.S. Pat. No. 5,588,845, entitled Connectors For Base Boards And Methods Of Connector For Base Boards. However, since these prior art elastomeric connectors are made with expensive high density parallel conductors, the prices of these elastomeric connectors are also high.

A need therefore exists for a new way to manufacture high density parallel connectors on a substrate that is low cost and does not require expensive manufacturing equipment. A need also exists for a method of producing high density parallel connectors in a more reliable manner. These needs are met by the present invention as described and claimed below.

SUMMARY of the INVENTION

The present invention is a high density connector element and its associated method of manufacture. The high density connector element contains a plurality of conductive wires that are arranged in parallel on the top surface of a flexible substrate. To manufacture the high density connector element, the flexible substrate is coated with an adhesive and wrapped around a cylindrical drum with the adhesive facing outwardly. Conductive wire is then wound around the cylindrical drum in a helical pattern. The conductive wire is densely wrapped around the flexible substrate on the cylindrical drum and is bound by the adhesive, thereby creating the high density connector element. After the winding is complete and the adhesive cured, at least one strip is cut from the high density connector element. The high density connector element has a flexible substrate and multiple conductive wires laid in parallel across the top surface of the substrate. Each of the conductive wires is electrically isolated from each of the other conductive wires, even when the wires are present in a highly dense pattern.

The high density connector element can be used to produce flexible cable connectors or can be used in the manufacture of elastomeric connectors.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
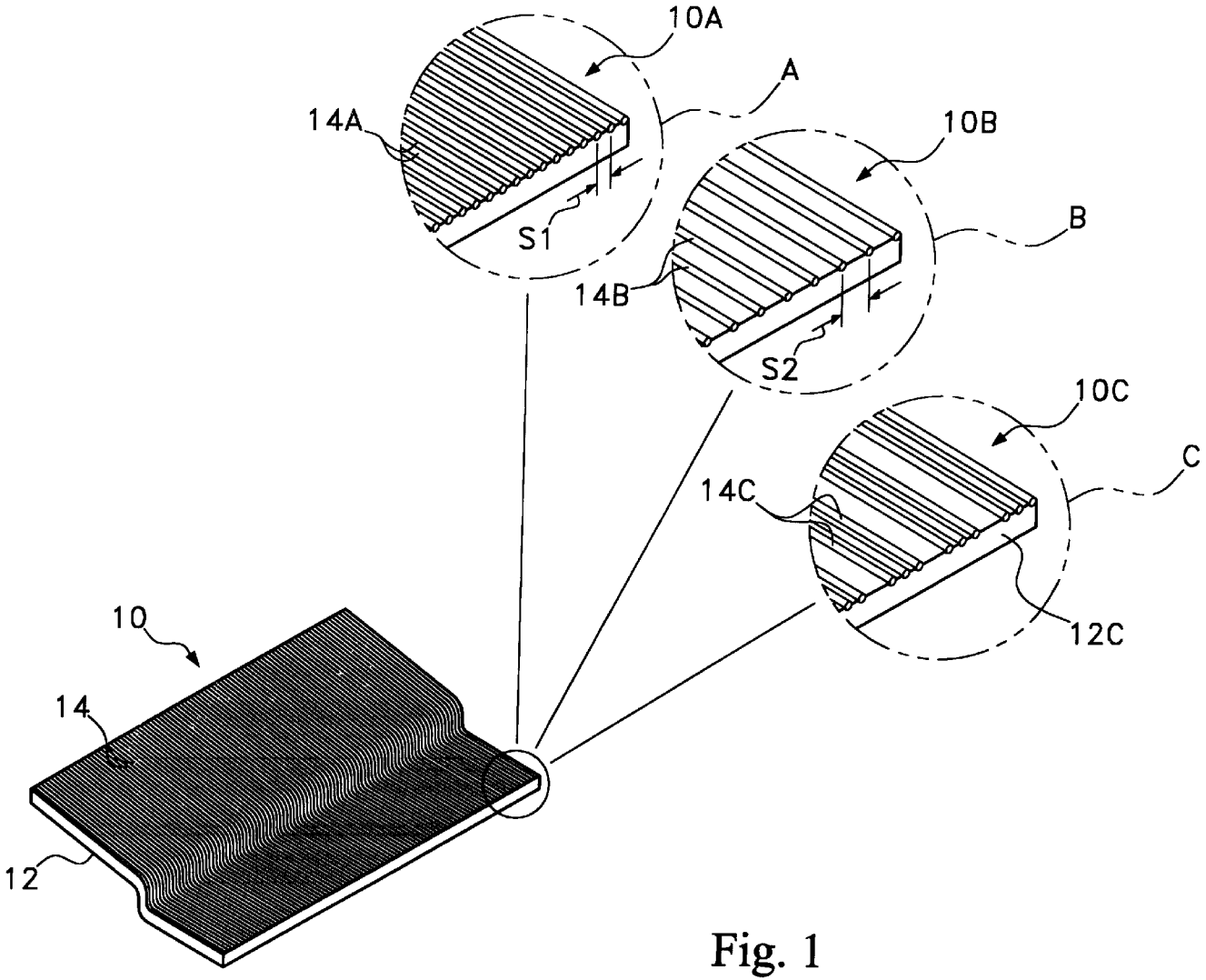
FIG. 1 is a perspective view of a segment of a high density connector element in accordance with the present invention, in the view are three enlarged areas, wherein each of the enlarged areas shows a slightly different exemplary configuration.

Referring to FIG. 1, an exemplary embodiment of high density connector element 10 is shown in accordance with the present invention. The high density connector element 10 is comprised of a flexible dielectric substrate 12. Attached to the flexible dielectric substrate 12 are a plurality of parallel conductive wires 14. The conductive wires 14 are permanently bonded to the flexible dielectric substrate 12 in a parallel orientation so that each of the conductive wires 14 are electrically isolated from each of the other conductive wires 14.

The conductive wires 14 are bonded to just the top surface of the flexible dielectric substrate 12. As such, any object that touches the top of the high density connector element 10 would contact at least some of the conductive wires 14.

The flexible dielectric substrate 12 can be any flexible dielectric material. However, experience has shown that b-stage cured silicone rubber or polyimide films work well as the substrate 12. Such substrate materials are currently commercially available at thicknesses of 0.005 inches. The high density connector element 10 preferably uses the thinnest flexible dielectric substrate 12 possible. As such, should the desired substrate materials be made thinner in the future, these thinner substrates can be adapted for use with the present invention.

The flexible dielectric substrate 12 is coated with an adhesive that remains flexible when cured. In the prior art, there are several thermoset adhesives that are used to manufacture flexible circuits. A thin film of any such thermoset adhesive can be adapted for use with the present invention. Prior to the curing of the flexible adhesive, the conductive wires 14 are applied to the top surface of the flexible dielectric substrate 12. The conductive wires 14 are uninsulated and are manufactured using known metal extrusion techniques. Using modern extrusion techniques, conductive wire can be made with very exacting tolerances. For the present invention high density conductive element, the conductive wires can have any diameter, however, wire diameter of between 0.0005 inches and 0.002 inches is preferred, depending upon the composition of the conductive wire. Alloys, such as Cu/Be/Ni/Au alloys are commercially produced into wires as thin as 0.0005 inches. Less exotic alloys, such as Cu/Be alloys are commercially produced into wires as thin as 0.001 inches. Pure gold is commonly made into wires that have a diameter of 0.002 inches.

The conductive wire can be made of various metals and alloys commonly used in the production of ultra-thin circuitry wire. However, unless the conductive wires 14 are made of a gold alloy, the conductive wires 14 preferably have a gold over nickel finish to ensure good contact conductivity.

In circle A of FIG. 1, an embodiment of the high density connector element 10A is shown where the conductive wire 14A is at its maximum density. In this embodiment, wire from the thinnest possible range is used. The conductive wire 14A is spaced so that the space S1 between the various stands of conductive wire 14A is no greater than the diameter of the conductive wire 14A being used. However, the space S1 in between strands of conductive wire 14A is larger than the dimensional tolerances used in the manufacture of the conductive wire 14A. In this manner, each strand of conductive wire 14A is positioned as close as possible to the adjacent wires without risk of any one conductive wire touching an adjacent conductive wire.

In circle B of FIG. 1, an embodiment of the connector element 10B is shown where larger diameter conductive wire 14B is used. Furthermore, the pitch of the spaces between the strands of conductive wire 14B is greatly increased. As such, a uniform spacing S2 exists between the conductive wires. The uniform spacing S2 can be any desired distance. However, spacing less than ten times the diameter of the conductive wire 14B is typically preferred.

In circle C of FIG. 1, an embodiment of the high density connector element 10C is shown where the pitch pattern of the spaces between the stands of conductive wire 14C is not uniform. Rather, the conductive wire 14C can be laid onto the dielectric substrate 12C with any desired pitch pattern. In the shown pitch pattern, the conductive wire 14C is laid down in groups of three. In each group, the conductive wires 14C are separated by a space no larger than the diameter of the conductive wire 14C being used. In between each group, the space may be any distance and it is preferably less than ten times the diameter of the conductive wire 14C being used. The use of three strands of conductive wire 14C in each group is merely exemplary and it should be understood that any plurality of conductive wires 14C can constitute a group.

Figure 2:
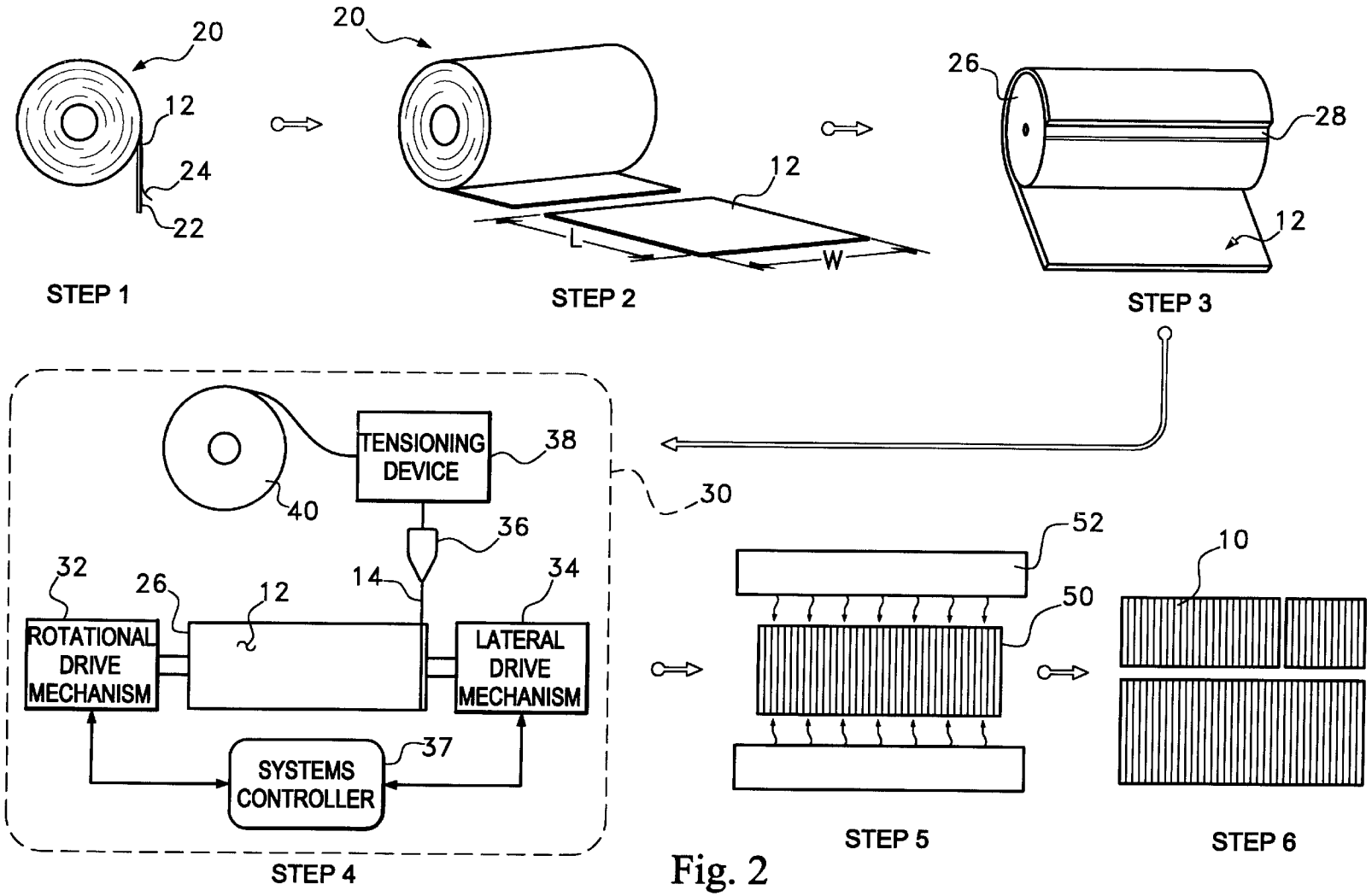
FIG. 2 is schematic showing the method of manufacture for a high density connector element.

Referring now to FIG. 2, an exemplary method of manufacturing the high density connector element can be described. From Step 1 in FIG. 2, it can be seen that a roll 20 of flexible dielectric substrate 12 is provided. The flexible dielectric substrate 12 in the roll 20 has a coating of thermoset adhesive 22 applied to its top surface. The thermoset adhesive 22 is covered with a removable protective cover sheet 24 to prevent the inadvertent contamination of the thermoset adhesive 22. The flexible dielectric substrate 12 can be purchased precoated with the thermoset adhesive 22 already applied, or else the thermoset adhesive 22 can be added to the flexible dielectric substrate 12 in an undescribed preparation procedure.

In Step 2 of the manufacturing method, a predetermined segment of flexible dielectric substrate 12 is cut from the role 20. The cut segment of the flexible dielectric substrate 12 has a length L and a width W. In Step 3, the segment of flexible dielectric substrate 12 is then mounted to the exterior of a cylindrical drum 26. The segment of flexible dielectric substrate 12 is mounted so that the thermoset adhesive faces away from the cylindrical drum 26. The cylindrical drum 26 has a length that is at least as long as the length L of the cut segment of flexible dielectric substrate 12. The external circumference of the cylindrical drum 26 is equal to the width W of the cut segment of flexible dielectric substrate 12. As a result, when the cut segment of flexible dielectric substrate 12 is placed on the cylindrical drum 26, the segment of flexible dielectric substrate 26 completely surrounds the cylindrical drum 26 without any significant seam, gap or overlap.

A strip of double sided tape 28 is applied to the cylindrical drum 26. The double sided tape 28 is applied in a straight line along the length of the cylindrical drum 26. To hold the segment of flexible dielectric substrate 12 in place, one edge of the segment is placed on the tape 28. The segment of flexible dielectric substrate 12 is then wound around the cylindrical drum 26, wherein the opposite edge also comes to rest over the double sided tape 28.

In Step 4, the cylindrical drum 26 is attached to a larger winding assembly 30. The winding assembly 30 contains a rotational drive mechanism 32 that rotates the cylindrical drum 26 around its central axis. The winding assembly 30 also contains a lateral drive mechanism 34 that moves the cylindrical drum 26 laterally back and forth along the line of the cylindrical drum's central axis. The rotational drive mechanism 32 and the lateral drive mechanism 34 are both controlled by a programmable systems controller 37.

Above the cylindrical drum 26 is located a stationary capillary head 36 and a tensioning mechanism 38. Conductive wire 14 from a spool 40 is fed through the tensioning mechanism 38 and the stationary capillary head 36. After the conductive wire 14 is installed in the capillary head, the protective cover sheet 24 is removed from the surface of the flexible dielectric substrate 12, thereby exposing the thermoset adhesive that coats the flexible dielectric substrate 12.

After the thermoset adhesive is exposed, the systems controller 37 then moves the cylindrical drum 26 so that the capillary head 36 is aligned with one end of the flexible dielectric substrate 12. A lead of wire 14 is then pulled through the capillary head 36 and is attached to the side of the cylindrical drum 26 with a piece of tape or another equivalent mechanical fastener. The cylindrical drum 26 is then turned manually at least one turn to start the rotation of the conductive wire 14 around the cylindrical drum 26.

Once the conductive wire 14 is properly primed around the cylindrical drum 26, the systems controller 37 enables the rotational drive mechanism 32 and the lateral drive mechanism 34. As has been previously explained, the rotational drive mechanism controls the rotation of the cylindrical drum 26. The lateral drive mechanism 34 controls the lateral movement of the cylindrical drum 26 under the stationary capillary head 36. The systems controller 37 is preprogrammed with a desired pitch pattern. The systems controller 37 selectively controls the rotational drive mechanism 32 and the lateral drive mechanism 34 to create the preprogrammed pitch pattern on the exterior of the cylindrical drum 26. As has been previously explained in reference to FIG. 1, the pitch pattern can cause uniform spaces between each rotation of wire 14 or can create patterns of wire groupings.

The winding assembly 30 creates the preprogrammed pitch pattern across the entire length of the segment of flexible dielectric substrate 12. After, the desired pitch pattern of conductive wire 14 is created along the flexible dielectric substrate 12, the conductive wire 14 is cut and secured to the cylindrical drum 26. The cylindrical drum 26 is then removed from the winding assembly 30.

The pitch pattern of conductive wire 14 contacts the thermoset adhesive coating the flexible dielectric substrate 12. As is indicated by Step 5, the entire cylindrical drum/substrate assembly 50 is then placed into a curing chamber 52. In the curing chamber 52, the temperature is sufficient to cure the thermoset adhesive. Once the thermoset adhesive achieves its activation temperature, cylindrical drum/substrate assembly 50 is allowed to set. Once set, the cylindrical drum/substrate 50 is removed from the curing chamber. When the thermoset adhesive is heated, the thermoset material flows around and between the bottom of the conductive wires 14. The coating of thermoset adhesive, however, is kept too thin to completely surround any part of the conductive wires 14. When the thermoset adhesive cures, the conductive wires 14 become bonded to the flexible dielectric substrate 12 via the thermoset adhesive.

In Step 6, after the cylindrical drum/substrate assembly 50 is cooled, the conductive wires 14 are cut along the seam between the two opposing edges of the flexible dielectric substrate 12. Optionally, both the flexible dielectric substrate 12 and the surrounding conductive wires 14 can also be cut along other lines that are parallel to the line of the seam.

Once the conductive wires 14 and underlying dielectric substrate 12 is cut, the cut section or sections can be removed from the cylindrical drum 26. Each removed section creates a section of high density connector element 10, such as that described with reference to FIG. 1.

Figure 3:
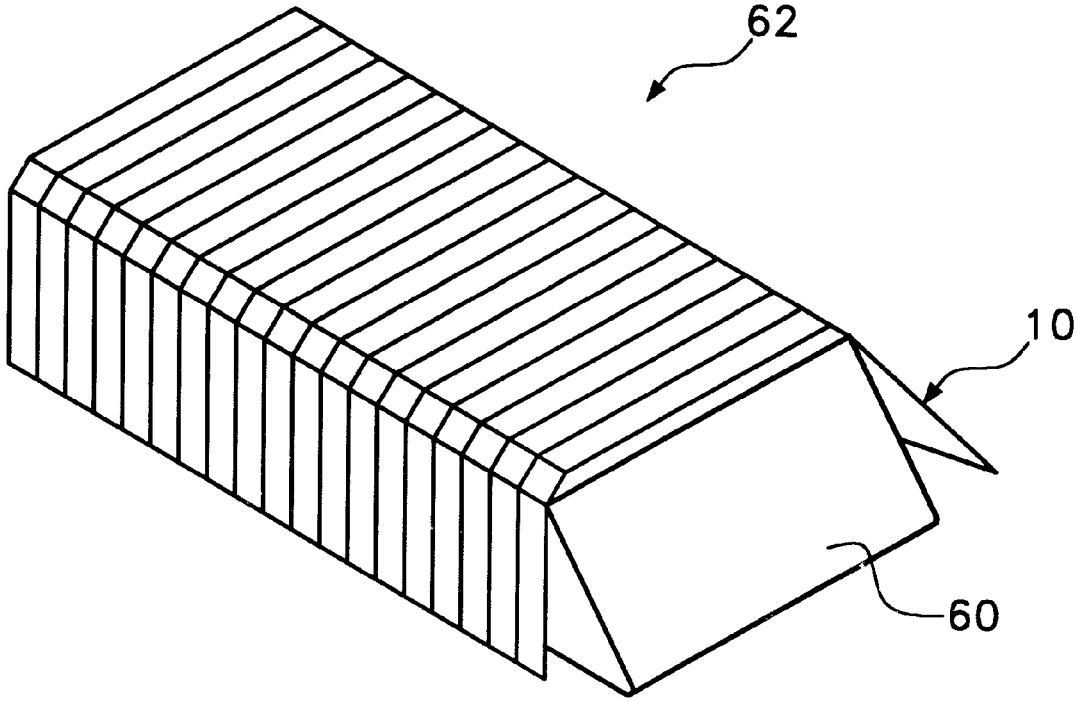
FIG. 3 is a perspective view of an elastomeric connector that utilizes a high density connector element as part of its structure.

Each section of high density connector element 10 can be cut into strips to create high-density flexible cables and ribbons. Alternatively, the sections of high density connector element can be used to create an elastomeric connector. Referring to FIG. 3, it can be seen that a section of a high density connector element 10 can be wrapped around a core 60 of elastomeric material. The high density connector element 10 can be attached to the elastomeric core 60 either mechanically or with the use of an adhesive. The resulting final product is an elastomeric connector 62 having rows of conductive wires 14 on its exterior, yet being low cost to manufacture.

It will be understood that the embodiments of the present invention described and illustrated herein are merely exemplary and a person skilled in the art can make many variations to the embodiment shown without departing from the scope of the present invention. For example, in the described method of manufacture, a laterally moving cylindrical drum was moved relative a stationary wire capillary. The same product could be made by providing both a cylindrical drum that is laterally stationary and the wire capillary that moves along the length of the cylindrical drum. All such variations, modifications and alternate embodiments are intended to be included within the scope of the present invention as defined by the appended claims.

What is claimed is:

1. A method of manufacturing a high density connector element, comprising the steps of:

providing a flexible dielectric substrate;

coating said flexible dielectric substrate with an adhesive;

wrapping said flexible dielectric substrate on a cylindrical drum, wherein said cylindrical drum has a central axis;

winding a conductive wire around said flexible dielectric substrate in a helical pattern, wherein said conductive wire contacts said adhesive but lays exposed above the adhesive;

curing said adhesive creating a tubular structure around said cylindrical drum;

cutting said tubular structure along at least one line that is parallel to said central axis of said cylindrical drum, thereby producing at least one segment of the high density connector element; and, removing said at least one connector element from said cylindrical drum.

2. The method according to claim 1, wherein said adhesive is a thermoset adhesive and said step of curing said adhesive includes heating said tubular structure around said cylindrical drum.

3. The method according to claim 1, wherein said flexible dielectric substrate is no greater than 0.005 inches in thickness.

4. The method according to claim 1, wherein said conductive wire has a diameter of no greater than 0.002 inches.

5. The method according to claim 1, wherein said step of winding a conductive wire includes evenly winding the conductive wire at a standard pitch.

6. The method according to claim 1, wherein said step of winding a conductive wire includes winding the conductive wire in a predetermined pattern, said predetermined pattern have more than one pitch of rotation.

7. A method of manufacturing an elastomeric connector, comprising the steps of:

placing a flexible substrate on a cylindrical drum;

winding a conductive wire around the cylindrical drum in a helical pattern;

adhering the conductive wire to the flexible substrate with an adhesive to create a connector element;

cutting a segment from said connector element; and attaching said segment of said connector element to at least one external surface of an elastomeric form.

8. The method according to claim 7, wherein said helical pattern is wound with a changing pitch at different points along said cylindrical drum.

* * * * *